US005337423A

United States Patent [19]

Young

[11] Patent Number: 5,337,423

[45] Date of Patent: Aug. 16, 1994

[54] HAIR RINSING APPARATUS

[76] Inventor: Bobbie L. Young, 6306 Willow Springs, Arlington, Tex. 76017

[21] Appl. No.: 901,171

[22] Filed: Jun. 19, 1992

[51] Int. Cl.[5] ..... A45D 19/00

[52] U.S. Cl. ..... 4/518; 132/212

[58] Field of Search ..... 4/515-522; 2/174; 132/212, 270

[56] References Cited

U.S. PATENT DOCUMENTS

| | | | |
|---|---|---|---|
| 493,953 | 3/1893 | Voss | 4/517 |
| 998,804 | 7/1911 | Salisbury . | |
| 2,812,519 | 11/1957 | Parks . | |
| 2,813,275 | 11/1957 | Davenport | 4/517 |
| 2,856,918 | 10/1958 | Kingery et al. . | |
| 2,914,066 | 11/1959 | Gow . | |
| 3,040,336 | 6/1962 | Plank | 4/521 |
| 3,177,868 | 4/1965 | Wallace | 4/517 X |
| 3,456,655 | 7/1969 | Hale . | |
| 3,692,066 | 9/1972 | Fava . | |
| 3,863,651 | 2/1975 | Valano . | |
| 4,361,158 | 11/1982 | Baker . | |
| 4,817,218 | 4/1989 | Dimitriu et al. . | |
| 4,987,618 | 11/1991 | Tolbert . | |
| 5.075,908 | 12/1991 | Newman | 4/516 X |
| 5,099,865 | 3/1992 | Flannery et al. | 4/516 X |
| 5,235,709 | 8/1993 | Terlep | 4/518 X |

FOREIGN PATENT DOCUMENTS

| | | | |
|---|---|---|---|
| 604378 | 5/1926 | France | 132/212 |

*Primary Examiner*—Charles E. Phillips
*Attorney, Agent, or Firm*—Frank P. Presta

[57] ABSTRACT

Apparatus for rinsing hair including a liquid impervious outer shell member and a liquid pervious inner shell member which define a fluid chamber therebetween, and constructed such that when the device is positioned on a user's head, the rear portion of the user's head is left uncovered thereby defining a rear opening through which the user's hair may extend. Preferably, the inner shell member covers a greater portion of the rear portion of the user's head than the outer shell member. A cape may be provided which extends around the rear portion of the user's hairline. A device for delivering liquid to the fluid chamber is provided. The apparatus is constructed such that when a user's head is in a tilted back position over a fluid basin or the like, fluid flows from the fluid chamber, through the hair of the user, out of the rear opening thereof, and into the fluid basin, thereby effectively rinsing the user's hair.

15 Claims, 2 Drawing Sheets

HAIR RINSING APPARATUS

BACKGROUND OF THE INVENTION

The present invention relates to a hair rinsing apparatus and, more particularly, to a new and improved hair rinsing apparatus for effectively rinsing a user's hair while the user's head is positioned over a fluid basin or the like.

The use of a hair rinsing device would be a desirable alternative to manual hair rinsing in many environments if it could automatically achieve effective hair rinsing with minimal human intervention. Such a device would be useful in rinsing the hair of people in nursing homes, hospitals, hair care facilities, private homes or the like, because it would provide a means for rinsing a person's hair without requiring someone to manually rinse it. Moreover, such a device would enable people who are incapable of rinsing their own hair to have their hair regularly rinsed in situations where manpower and time constraints may not permit it to be done manually. An economical hair rinsing device would be particularly useful in hair care facilities after shampooing or for rinsing out permanents. Such a device would also be useful for rinsing small children's hair because it would eliminate the possibility of getting fluid in the child's face, eyes or ears.

Therefore, a need has been created for an economical hair rinsing apparatus which can easily be positioned on the head of a user, and which provides thorough and effective hair rinsing regardless of the length or style of the user's hair. The hair rinsing apparatus of the present invention meets this need.

BRIEF DESCRIPTION OF THE RELATED ART

Various hair rinsing devices are known in the art as evidenced by the patents to Salisbury No. 998,804, Dimitriu et al No. 4,817,218 and Tolbert No. 4,987,618.

The patent to Salisbury discloses a hair rinsing apparatus having a helmet configuration which includes inner and outer shell members defining a fluid chamber therebetween, wherein the inner shell includes a plurality of perforations to communicate fluid therethrough. Owing to the fact that the device covers the entire rear portion of the head and has only a small fluid outlet port, the device does not enable the rinsing of hair of various lengths with a single device. The device also does not provide a means for diverting fluid away from the user's neck.

The patent to Dimitriu et al discloses a hair rinsing apparatus which also includes inner and outer shell members and is constructed for use with a fluid basin. Similarly, this device covers the entire rear portion of the head and has relatively small outlet ports therein which does not enable the device to be used effectively with long hair.

The patent to Tolbert also discloses a hair rinsing apparatus including inner and outer shell members which both completely cover the rear portion of the user's head. This device also is not effective for use with hair of various lengths.

While the known hair rinsing devices work satisfactorily in some instances, they do not provide a device which can easily and effectively be used to thoroughly rinse hair regardless of the length thereof. Moreover, the relatively small fluid outlet ports adversely limit the volume of rinsing fluid which can flow through the device without leaking around the edges thereof. The limited flow provided by the known devices is often less than is required to achieve thorough rinsing in a short period of time. In addition, the use of the known devices often results in escaping fluid running down the neck and body of the user. The small outlet ports are also susceptible to clogging by hair or other debris and are difficult to keep clean.

The new and improved hair rinsing apparatus of the present invention overcomes the disadvantages of the known hair rinsing apparatus hereinbefore described and possesses advantages not found in the known apparatus.

SUMMARY OF THE INVENTION

Accordingly, it is a primary object of the present invention to provide an inexpensive and effective hair rinsing apparatus which can easily be used to thoroughly rinse a user's hair regardless of the style or length thereof, and which does not result in rinsing fluid running down the neck or body of the user.

Another object of the present invention is to provide a hair rinsing apparatus which is portable and can economically be used in a variety of environments to achieve effective hair rinsing.

A further object of the present invention is to provide a hair rinsing apparatus which includes a liquid impervious outer shell member which partially covers a user's head and has a first perimeter rim for securement about the front hairline of the user and a second perimeter rim which extends around the rear portion of the user's head to define a rear opening whereby the rear portion of the user's head is left uncovered so that the user's hair may extend therethrough. A liquid pervious inner shell member is positioned within the outer shell member and has a third perimeter rim which extends substantially adjacent to the first perimeter rim and a fourth perimeter rim which substantially corresponds and is secured to the second perimeter rim of the outer shell member, thereby defining a fluid chamber between the inner and outer shell members. A device for delivering liquid to the fluid chamber is provided. The inner shell member is operable to communicate liquid to the user's hair so that, when the user's head is in a tilted back position over a fluid basin or the like, liquid flows through the hair of the user, out of the rear opening thereof and into the fluid basin.

A more particular object of the present invention is to provide an inner shell member rear portion which extends beyond the second perimeter rim of the outer shell member and covers the upper rear portion of the user's head.

Yet another object of the invention is to provide a cape member which is secured adjacent the first perimeter rim such that the cape extends around the back portion of the user's hairline. The cape member can be positioned in the fluid basin or the like to direct liquid flowing out of the rear opening away from the neck of the user and into the fluid basin.

DESCRIPTION OF THE DRAWINGS

Other objects and advantages of the subject invention will become apparent from a study of the following specification when viewed in light of the accompanying drawings, in which.

DETAILED DESCRIPTION

Figure 1:
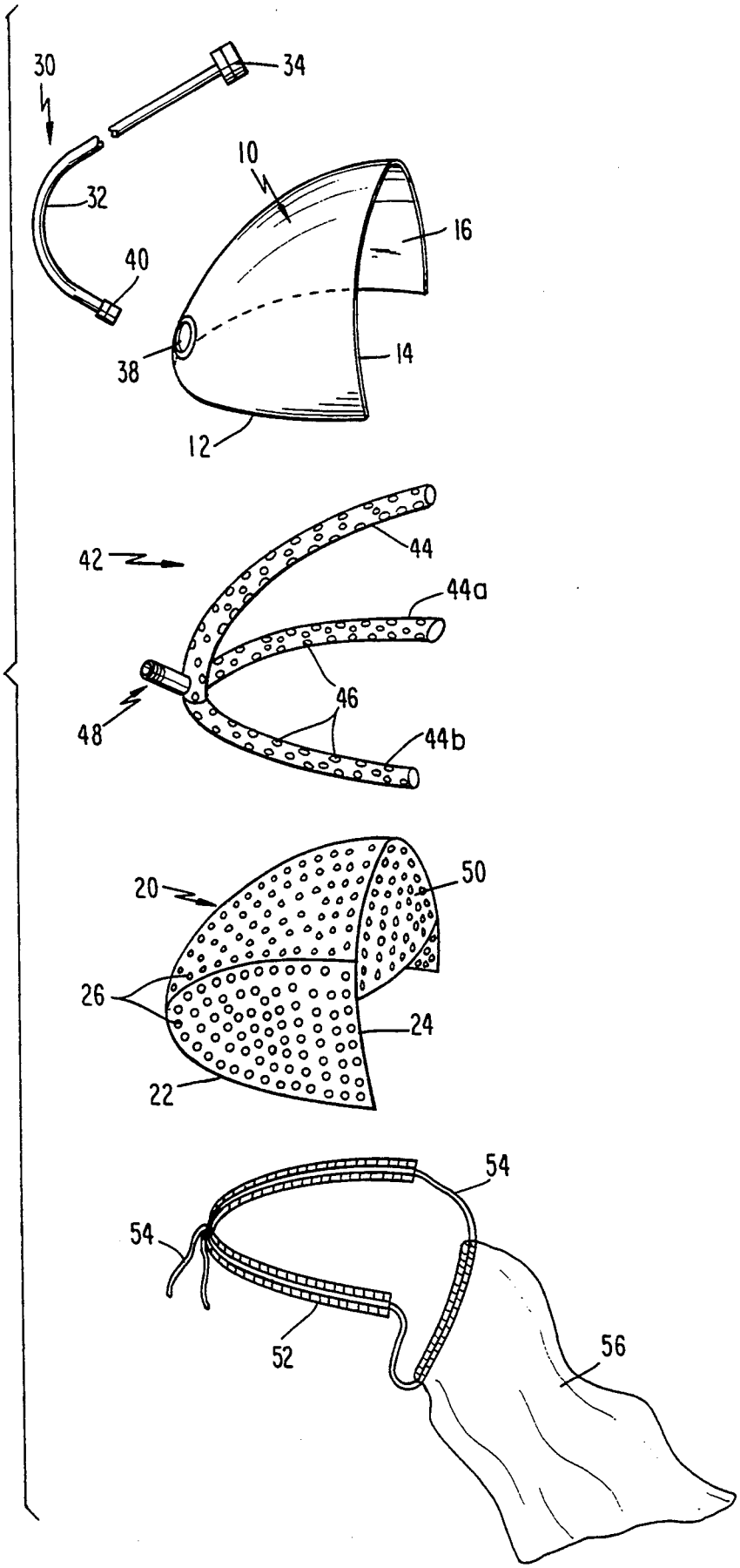
FIG. 1 is a exploded view of the hair rinsing apparatus of the present invention.
Figure 2:
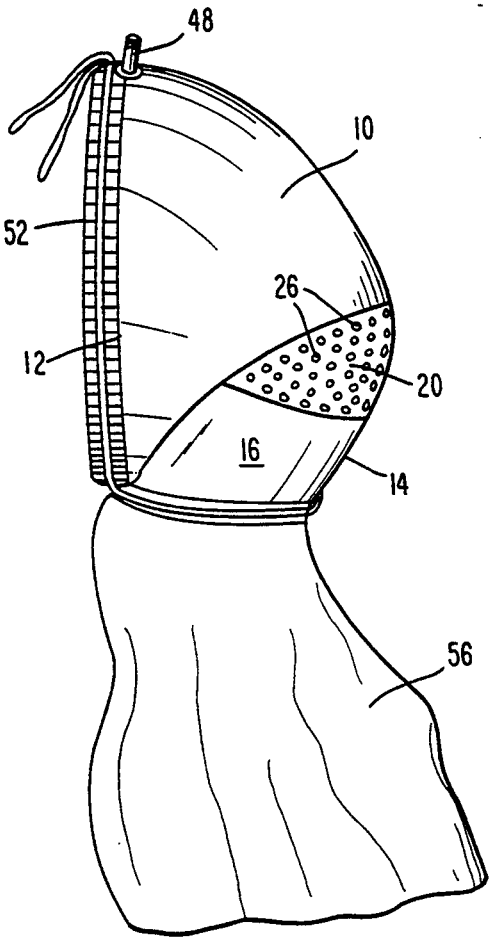
FIG. 2 is a side elevational view of the hair rinsing apparatus of FIG. 1.
Figure 3:
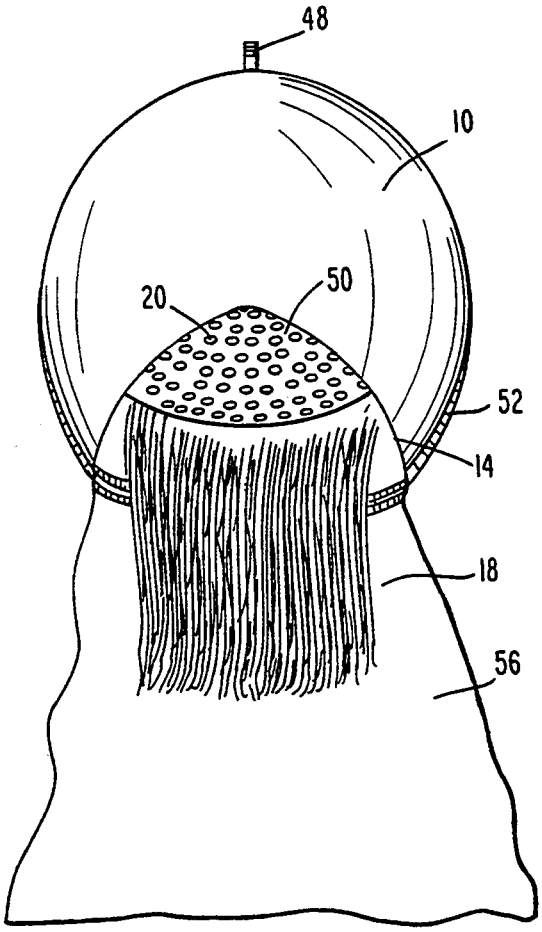
FIG. 3 is a rear elevational view of the apparatus of FIG. 2 positioned on a user, wherein the hair of the user extends through the rear opening thereof.
Figure 4:
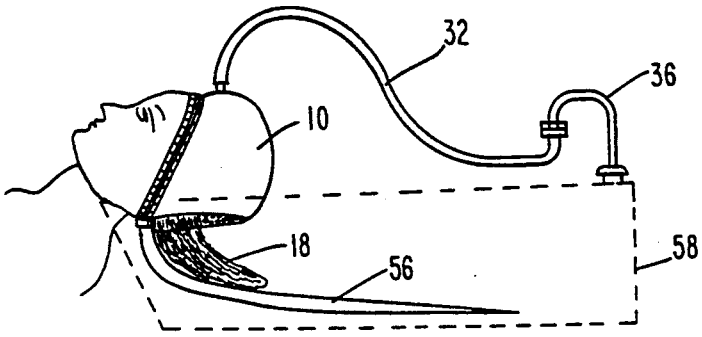
FIG. 4 is a side elevational view of the apparatus of FIGS. 2 and 3 in operation, wherein the user's head is positioned over a fluid basin and the apparatus is connected to a liquid source.

Referring now to FIGS. 1 through 4 wherein like reference numerals designate similar parts throughout the various views, the hair rinsing apparatus of the present invention includes a liquid impervious outer shell member 10 which is constructed to partially cover a user's head. The outer shell member 10 includes a first perimeter rim 12 constructed for securement about the front hairline of the user and a second perimeter rim 14 which extends around the rear portion of the user's head, thereby defining a rear opening 16 wherein the rear portion of the user's head may be left uncovered when positioned thereon so that the user's hair 18 may extend therethrough. As used herein, the rear portion of the user's head is generally defined as the rear cranial portion of the head extending substantially from the top of the head to the hairline on the back of the neck. The outer shell member 10 preferably is made of a durable plastic material but may be made of any other suitable liquid impervious material. The outer shell member 10 may either be a decorative color or transparent.

A liquid pervious inner shell member 20 is constructed to substantially correspond to the outer shell member 10 in size and shape so that it can be positioned therein. The inner shell member 20 includes a third perimeter rim 22 which extends substantially adjacent to the first perimeter rim 12 and preferably is secured thereto. The inner shell member 20 also includes a fourth perimeter rim 24 which substantially corresponds and is secured to the second perimeter rim 14. Owing to this configuration, there is defined a fluid chamber between the inner shell member 20 and the outer shell member 10. Preferably, the inner shell member 20 is made of a durable nylon material having a matrix of fluid openings 26 therein, but may be made of any other liquid pervious suitable material.

A device 30 is provided for delivering liquid to the fluid chamber defined between the inner shell member 20 and the outer shell member 10. Preferably the liquid delivery device 30 includes an elongated hose member 32 having a first end 34 which is operable to be connected to a fluid source, such as a sink faucet 36 (FIG. 4) or the like, and a second end 40 which is operable to deliver liquid through the outer shell member 10. Preferably, an opening 38 is provided in the outer shell member 10 which forms a fluid tight seal around the hose member second end 40, thereby enabling fluid to be delivered to the fluid chamber between the inner and outer shell members.

Preferably, the liquid delivery device 30 further includes a means 42 positioned within the fluid chamber for evenly dispersing the liquid throughout the fluid chamber. Preferably, the means 42 for dispersing the fluid includes at least one fluid dispersing hose 44 having one end in fluid communication with the hose member 32, via a connector 48 extending through the outer shell opening 38, and having a plurality of fluid openings 46 along its length, thereby substantially evenly dispersing the liquid in the fluid chamber. In a preferred embodiment, a pair of additional dispersing hoses **44*a* and 44*b* are connected to the hose 44 and extend adjacent the first perimeter rim 12 of the outer shell member 10**.

In accordance with the invention, the inner shell member 20 may include an inner shell rear portion 50 which extends beyond the second perimeter rim 14 of the outer shell member 10. As most clearly shown in FIG. 3, the inner shell rear portion 50 covers the upper rear portion of the user's head while the lower rear portion of the user's head remains uncovered so that hair may extend therethrough. In this embodiment, it can be seen that the inner shell member 20 covers more of the rear portion of the user's head than the outer shell member 10 covers. Preferably, the inner shell rear portion 50 is made of the same material as the inner shell member 20 and includes a plurality of fluid openings therein. The inner shell rear portion 50 enhances rinsing of the hair without adversely limiting the volume of the rinsing fluid which is capable of flowing through the apparatus at any given time.

In order to facilitate water-tight securement of the hair rinsing apparatus about the user's hairline, an elastomeric band 52 is secured to the first perimeter rim 12 of the outer shell member 10. The elastomeric band 52 may include an adjusting drawstring 54 therein to provide enhanced securement about the user's hairline.

In accordance with a further embodiment of the invention, a cape member 56 may be connected adjacent the first perimeter rim 12 such that the cape member 56 extends around the back portion of the user's hairline. Preferably, the cape member 56 is adjustably connected to the elastomeric band 52 by the drawstring 54 so that the cape member 56 can be adjustably positioned on the user and to enable the device to be easily positioned on a user regardless of the length of the user's hair. The cape member 56 may be made of any suitable fluid impervious material. Preferably, the cape member 56 is approximately sixteen inches in length and tapers outwardly from about six inches at the hairline of the user to about fourteen inches at the bottom thereof. However, any other suitable cape size which can protect the user and lay inside the fluid basin employed may be used.

The hair rinsing apparatus of the present invention is constructed to be positioned on a user's head and is operable to effectively rinse the user's hair while the user's head is in a tilted back position over a fluid basin or the like. When the hose member 32 is connected to a liquid source, the liquid flows into the fluid chamber, through the liquid pervious inner shell member 20 to the hair of the user, out the rear opening 16, and into a fluid basin 58 or the like. The cape member 56 is operable to be positioned in the fluid basin 58 to direct the fluid flowing out of the rear opening 16 away from the neck of the user and into the fluid basin 58, thereby preventing fluid from running down the neck and back of the user.

In accordance with the invention, the hair rinsing apparatus may be used while the user's head is positioned over a conventional rinsing sink as found in hair care facilities or the like, or the apparatus can be used with a portable rinsing bowl which can be placed under a user's head to catch the rinsing fluid. A portable rinsing bowl is useful if the apparatus is going to be used for rinsing the hair of people who cannot easily be positioned over a conventional sink such as people in hospitals, nursing homes or the like.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. Apparatus for rinsing hair, comprising:

(a) a liquid impervious outer shell member for partially covering a user's head having a first perimeter rim for securement about the front hairline of the user and a second perimeter rim which extends around the rear portion of the user's head defining a rear opening, wherein the rear portion of the user's head is left uncovered when the apparatus is positioned thereon so that hair may extend therethrough;

(b) a liquid pervious inner shell member positioned within said outer shell member having a third perimeter rim which extends substantially adjacent to said first perimeter rim, and a fourth perimeter rim which substantially corresponds and is secured to said second perimeter rim, a fluid chamber being defined between said inner and said outer shell members; said inner shell member including an inner shell rear portion which extends beyond said second perimeter rim of said outer shell member and covers the upper rear portion of the user's head, whereby said inner shell member covers more of the rear portion of the user's head than said outer shell member, and the lower rear portion of the user's head is left uncovered so that hair may extend therethrough; and (c) means for delivering hair rinsing liquid to said fluid chamber, said inner shell member being operable to convey the liquid from said fluid chamber to the user's hair, whereby when the user's head is in a tilted back position over a fluid basin or the like, fluid flows through the hair of the user, out said rear opening and into the fluid basin.

2. Apparatus as defined in claim 1, wherein said outer shell member is made of a flexible material.

3. Apparatus as defined in claim 1, wherein said inner shell member is made of a flexible material.

4. Apparatus as defined in claim 1, wherein said inner shell member includes a plurality of fluid openings therein.

5. Apparatus as defined in claim 1, wherein said means for delivering liquid includes a hose member having a first end which is operable to be connected to a liquid source and a second end which is operable to deliver liquid through said outer shell member to said fluid chamber.

6. Apparatus as defined in claim 5, wherein said means for delivering liquid further includes means positioned within said fluid chamber for dispersing said liquid substantially evenly throughout said fluid chamber.

7. Apparatus as defined in claim 6, wherein said means for dispersing said liquid includes at least one dispersing hose having one end in fluid communication with said hose member, said dispersing hose having a plurality of fluid openings along its length.

8. Apparatus as defined in claim 7, wherein said means for dispersing said liquid includes a plurality of fluid dispersing hoses spaced throughout said fluid chamber.

9. Apparatus as defined in claim 1 wherein said means for delivering hair rinsing liquid to said fluid chamber is disposed near the front hairline of the user.

10. Apparatus as defined in claim 1, wherein said inner shell rear portion includes a plurality of fluid openings therein.

11. Apparatus as defined in claim 1, and further including a cape member connected adjacent said perimeter rim for facilitating fluid-tight securement about the user's hairline.

12. Apparatus as defined in claim 11, and further including a cape member connected adjacent said first perimeter rim such that the cape member extends around the back portion of the user's hairline, said cape member being operable to be positioned in a fluid basin or the like to direct liquid flowing out of said rear opening away from the neck of the user and into the fluid basin.

13. Apparatus as defined in claim 12, wherein said cape member is adjustably connected with said elastomeric band to enable said cape to be adjusted relative thereto.

14. Apparatus for rinsing hair, comprising:

(a) a liquid impervious outer shell member for partially covering a user's head having a first perimeter rim for securement about the front hairline of the user and a second perimeter rim which extends around the rear portion of the user's head defining a rear opening, wherein the rear portion of the user's head is left uncovered when the apparatus is positioned thereon so that hair may extend therethrough;

(b) a liquid pervious inner shell member positioned within said outer shell member having a third perimeter rim which extends substantially adjacent to said first perimeter rim, and a fourth perimeter rim which substantially corresponds and is secured to said second perimeter rim, a fluid chamber being defined between said inner and said outer shell members;

(c) means for delivering hair rinsing liquid to said fluid chamber, said inner shell member being operable to convey the liquid from said fluid chamber to the user's hair, whereby when the user's head is in a tilted back position over a fluid basin or the like, fluid flows through the hair of the user, out said rear opening and into the fluid basin;

(d) an elastomeric band secured to said first perimeter rim for facilitating fluid-tight securement about the user's hairline; and (e) a cape member connected adjacent said first perimeter rim such that the cape member extends round the back portion of the user's hairline, said cape member being operable to be positioned in a fluid basin or the like to direct liquid flowing out of said rear opening away from the neck of the user and into the fluid basin, said cape member being adjustably connected with said elastomeric band to enable said cape member to be adjusted relative thereto.

15. Apparatus as defined in claim 14, wherein said elastomeric band includes an adjusting draw-string therein operable to facilitate securement about the user's hairline, and further wherein said cape is connected with said elastomeric band by said draw-string.

* * * * *